US012781768B2

(12) United States Patent
Chen et al.

(10) Patent No.: US 12,781,768 B2
(45) Date of Patent: Nov. 3, 2026

(54) AXIAL FAN

(71) Applicant: DAIKIN INDUSTRIES, LTD, Osaka (JP)

(72) Inventors: Zuozhou Chen, Osaka (JP); Kaname Maruyama, Osaka (JP); Anan Takada, Osaka (JP); Ryusuke Otaguro, Osaka (JP); Hideaki Konishi, Osaka (JP); Hirotaka Tomioka, Osaka (JP); Takashi Kashihara, Osaka (JP); Satoshi Nakai, Osaka (JP); Yuki Yamashita, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/851,032

(22) PCT Filed: Mar. 14, 2023

(86) PCT No.: PCT/JP2023/009786
§ 371 (c)(1),
(2) Date: Sep. 25, 2024

(87) PCT Pub. No.: WO2023/189522
PCT Pub. Date: Oct. 5, 2023

(65) Prior Publication Data

US 2025/0243880 A1 Jul. 31, 2025

(30) Foreign Application Priority Data

Mar. 31, 2022 (JP) ..... 2022-060652

(51) Int. Cl.
*F04D 19/00* (2006.01)
*F04D 29/38* (2006.01)
*F04D 29/66* (2006.01)

(52) U.S. Cl.
CPC ..... *F04D 29/666* (2013.01); *F04D 19/002* (2013.01); *F04D 29/384* (2013.01); *F04D 29/388* (2013.01)

(58) Field of Classification Search
CPC ..... F04D 19/002; F04D 29/38; F04D 29/388; F04D 29/666; F04D 29/384
See application file for complete search history.

(56) References Cited

U.S. PATENT DOCUMENTS 5,257,902 A * 11/1993 Atarashi ..... F04D 29/023 415/119
6,994,522 B1 * 2/2006 Chin-Chih ..... F04D 29/388 55/467

(Continued)

FOREIGN PATENT DOCUMENTS

CN 102644623 A 8/2012
CN 107355425 A 11/2017

(Continued)

OTHER PUBLICATIONS

Machine Translation of JP-H03237298-A; Retrieved from ESPACENET on Sep. 24, 2025 (Year: 2025).*

(Continued)

*Primary Examiner* — Sang K Kim
(74) *Attorney, Agent, or Firm* — Spencer Fane LLP

(57) ABSTRACT

An axial fan includes a hub attachable to a rotary shaft, and five or less blades arranged on the hub. Each blade includes a leading edge located forward in a rotation direction of the rotary shaft, a trailing edge located rearward in the rotation direction of the rotary shaft, and a porous part. A dimension from the leading edge to the trailing edge is a blade chord length, and the porous part is arranged at a position located rearward from the leading edge by 40% or more of the blade chord length.

6 Claims, 6 Drawing Sheets

(56) References Cited

U.S. PATENT DOCUMENTS

| | | | | |
|---|---|---|---|---|
| 2004/0101409 | A1* | 5/2004 | Jung | F04D 29/38 416/223 R |
| 2014/0363306 | A1* | 12/2014 | Kojima | F04D 19/002 416/242 |

FOREIGN PATENT DOCUMENTS

| | | | | | |
|---|---|---|---|---|---|
| JP | 62-45395 | U | | 3/1987 | |
| JP | H03237298 | A | * | 10/1991 | |
| JP | H05196243 | A | * | 8/1993 | |
| JP | 2754862 | B2 | | 5/1998 | |
| JP | 2005188376 | A | * | 7/2005 | F04D 29/388 |
| JP | 2005-240748 | A | | 9/2005 | |
| JP | 2005240749 | A | * | 9/2005 | F04D 29/388 |
| JP | 2021-32137 | A | | 3/2021 | |

OTHER PUBLICATIONS

Machine Translation of JP-H05196243-A; Retrieved from ESPACENET on Sep. 24, 2025 (Year: 2025).*
Machine Translation of Jp 2005-188376A; Retrieved from ESPACENET on Sep. 24, 2025 (Year: 2025).*
Machine translation of JP2005240749A; Retrieved from ESPACENET on Mar. 30, 2026 (Year: 2026).*
International Preliminary Report of corresponding PCT Application No. PCT/JP2023/009786 dated Oct. 10, 2024.
International Search Report of corresponding PCT Application No. PCT/JP2023/009786 dated May 30, 2023.
European Search Report of corresponding EP Application No. 23 77 9542.2 dated Oct. 6, 2025.

* cited by examiner

AXIAL FAN

CROSS-REFERENCE TO RELATED APPLICATIONS

This application is a U.S. National stage application of PCT/JP2023/009786. This U.S. National stage application claims priority under 35 U.S.C. § 119 (a) to Japanese Patent Application Nos. 2022-060652, filed in Japan on Mar. 31, 2022, the entire contents of which are hereby incorporated herein by reference.

BACKGROUND

Technical Field

The present disclosure relates to an axial fan.

Background Information

An axial fan includes a hub and blades arranged on the hub. The hub is attached to a rotary shaft. The blades and the hub rotate as the rotary shaft rotates. The rotation of the blades may cause pressure fluctuations, which generate noise. Japanese Patent No. 2754862 discloses a blade that includes a porous portion. The porous portion reduces the pressure difference between the side of a positive pressure surface and the side of a negative pressure surface of the blade. This mitigates the pressure fluctuations, thereby reducing noise.

SUMMARY

The porous portion arranged in the blade may decrease the strength of the blade.

An axial fan that solves the above problem includes a hub and five or less blades. The hub is for attachment to a rotary shaft. The blades are arranged on the hub. The blades each include a leading edge located forward in a rotation direction of the rotary shaft, a trailing edge located rearward in the rotation direction of the rotary shaft, and a porous part. When a dimension from the leading edge to the trailing edge is referred to as a blade chord length, the porous part is arranged at a position located rearward from the leading edge by 40% or more of the blade chord length.

When the number of blades is five or less, noise is likely to be generated at the trailing edge side of the blade. Thus, the porous part being located rearward from the leading edge by 40% or more of the blade chord length reduces the noise generated at the trailing edge side of the blade. When the porous part is arranged adjacent to a location where noise is generated, the porous part may be reduced in size as compared to when the porous part is arranged over the entire blade. This limits decreases in the strength of the blade.

In the above axial fan, the blades may each include an inner peripheral edge joined to the hub, and an outer peripheral edge extending between the leading edge and the trailing edge in the rotation direction of the rotary shaft. The trailing edge may include an inner peripheral connecting part connected to the inner peripheral edge, an outer peripheral connecting part connected to the outer peripheral edge, a first section extending from the inner peripheral connecting part toward the leading edge, a second section extending from the outer peripheral connecting part toward the leading edge, and a third section curved and connecting the first section and the second section. When a length of a trajectory in the rotation direction from the leading edge to a center position of the third section is referred to as a first distance, and a length of the trajectory in the rotation direction from the leading edge to an intersection at which the trajectory intersects an imaginary line segment connecting the first section and the second section is referred to as a second distance, the first distance may be 95% or less of the second distance. When a range obtained by extending, in the rotation direction, a circular range centered on the center position of the third section and having a radius that is 5 mm greater than a radius of the third section is referred to as a non-arrangement range, the porous part may be located at a position outside the non-arrangement range.

Stress tends to concentrate in the third section. Thus, if the distance between the third section and the porous part is excessively short, the strength of the blade may decrease. When the porous part is located outside the non-arrangement range obtained by extending, in the rotation direction, the circular range centered on the center position of the third section and having the radius that is 5 mm greater than the radius of the third section, decreases in the strength of the blade are limited as compared to when the porous part is located inside the non-arrangement range.

In the above axial fan, the blades may each include an inner peripheral edge joined to the hub, and an outer peripheral edge extending between the leading edge and the trailing edge in the rotation direction of the rotary shaft. The porous part may be shifted from a center position, between the inner peripheral edge and the outer peripheral edge, toward the outer peripheral edge.

The relative velocity of an airflow becomes higher toward the outer peripheral edge. Further, an airflow having a higher relative velocity is more likely to generate noise. Thus, the porous part shifted from the center position, between the inner peripheral edge and the outer peripheral edge, toward the outer peripheral edge reduces noise.

In the above axial fan, the porous part may have an area that is 30% or less of an entire area of a positive pressure surface of a corresponding one of the blades.

An axial fan that solves the above problem includes a hub and a blade. The hub is for attachment to a rotary shaft. The blade is arranged on the hub. The blade includes a leading edge located forward in a rotation direction of the rotary shaft, a trailing edge located rearward in the rotation direction of the rotary shaft, an inner peripheral edge joined to the hub, an outer peripheral edge extending between the leading edge and the trailing edge in the rotation direction of the rotary shaft, and a porous part. The trailing edge includes an inner peripheral connecting part connected to the inner peripheral edge, an outer peripheral connecting part connected to the outer peripheral edge, a first section extending from the inner peripheral connecting part toward the leading edge, a second section extending from the outer peripheral connecting part toward the leading edge, and a third section curved and connecting the first section and the second section. When a length of a trajectory in the rotation direction from the leading edge to a center position of the third section is referred to as a first distance, and a length of the trajectory in the rotation direction from the leading edge to an intersection at which the trajectory intersects an imaginary line segment connecting the first section and the second section is referred to as a second distance, the first distance is 95% or less of the second distance. When a range obtained by extending, in the rotation direction, a circular range centered on the center position of the third section and having a radius that is 5 mm greater than a radius of the third section is referred to as a non-arrangement range, the porous part is located at a position outside the non-arrangement range.

Stress tends to concentrate in the third section. Thus, if the distance between the third section and the porous part is excessively short, the strength of the blade may decrease. When the porous part is arranged at a position outside the non-arrangement range, decreases in the strength of the blade are limited as compared to when the porous part is arranged inside the non-arrangement range.

An axial fan that solves the above problem includes a hub and six or more blades. The hub is for attachment to a rotary shaft. The blades are arranged on the hub. The blades each include a leading edge located forward in a rotation direction of the rotary shaft, a trailing edge located rearward in the rotation direction of the rotary shaft, and a porous part. When a dimension from the leading edge to the trailing edge is referred to as a blade chord length, the porous part is arranged at a position located forward from the trailing edge by 60% or more of the blade chord length.

When the number of blades is six or more, noise is likely to be generated at the leading edge side of the blade. Thus, the porous part arranged at a position located forward from the trailing edge by 60% or more of the blade chord length reduces the noise generated at the leading edge side of the blade. When the porous part is arranged adjacent to a location where noise is generated, the porous part may be reduced in size as compared to when the porous part is arranged over the entire blade. This limits decreases in the strength of the blade.

DETAILED DESCRIPTION OF EMBODIMENT(S)

First Embodiment

A first embodiment of an axial fan will now be described.

Air Conditioner

Figure 1:
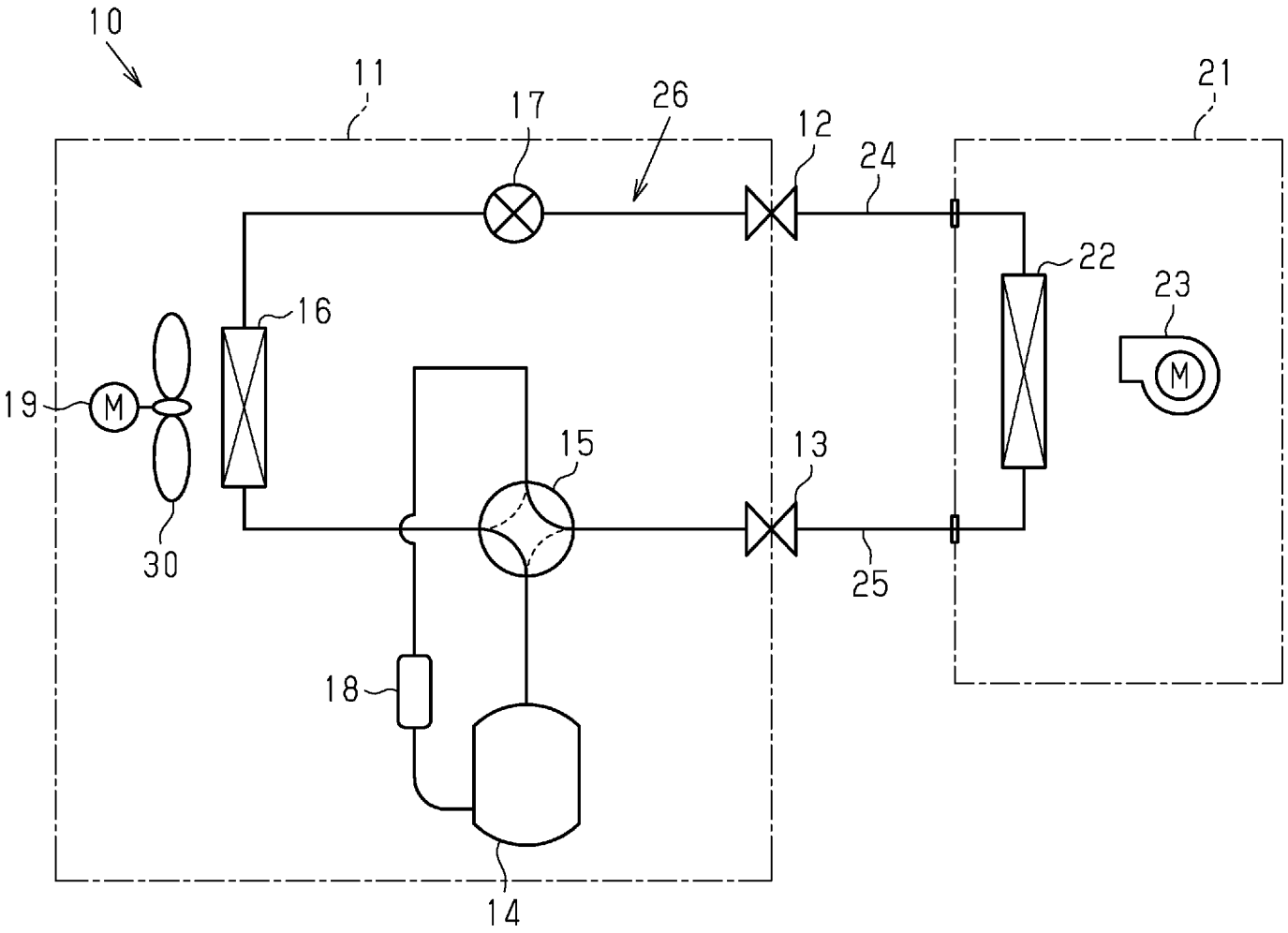
FIG. 1 is a schematic diagram showing the configuration of an air conditioner.

As shown in FIG. 1, an air conditioner 10 includes an outdoor unit 11, an indoor unit 21, and pipes 24 and 25. The outdoor unit 11 includes shutoff valves 12 and 13, a compressor 14, a four-way valve 15, an outdoor heat exchanger 16, an expansion valve 17, an accumulator 18, an axial fan 30, and a fan motor 19. The indoor unit 21 includes an indoor heat exchanger 22 and an indoor fan 23.

The pipes 24 and 25 connect the outdoor unit 11 and the indoor unit 21. The pipes 24 and 25 are connected to the shutoff valves 12 and 13, respectively. The indoor unit 21 and the outdoor unit 11 are connected by the pipes 24 and 25 so that the air conditioner 10 includes a refrigerant circuit 26. The refrigerant circuit 26 is a circuit through which a refrigerant flows. The refrigerant circuit 26 includes the compressor 14, the four-way valve 15, the outdoor heat exchanger 16, the expansion valve 17, the accumulator 18, and the indoor heat exchanger 22.

During a cooling operation of the air conditioner 10, the four-way valve 15 is switched so that the refrigerant discharged from the compressor 14 is directed to the outdoor heat exchanger 16. The outdoor heat exchanger 16 transfers heat between the outdoor air and the refrigerant. The refrigerant, whose heat is dissipated in the outdoor heat exchanger 16, is depressurized by the expansion valve 17. The refrigerant depressurized by the expansion valve 17 flows into the indoor heat exchanger 22. The indoor heat exchanger 22 transfers heat between the indoor air and the refrigerant. The refrigerant that obtained heat from the indoor air in the indoor heat exchanger 22 is drawn back into the compressor 14 through the four-way valve 15 and the accumulator 18. The indoor air, whose heat is dissipated through the heat exchange in the indoor heat exchanger 22, cools the room. The axial fan 30 supplies the outdoor air to the outdoor heat exchanger 16. The indoor fan 23 supplies the indoor air to the indoor heat exchanger 22.

During a heating operation of the air conditioner 10, the four-way valve 15 is switched so that the refrigerant discharged from the compressor 14 is directed to the indoor heat exchanger 22. The indoor heat exchanger 22 transfers heat between the indoor air and the refrigerant. The refrigerant that dissipated heat in the indoor heat exchanger 22 is depressurized by the expansion valve 17. The refrigerant depressurized by the expansion valve 17 flows into the outdoor heat exchanger 16. The outdoor heat exchanger 16 transfers heat between the outdoor air and the refrigerant. The refrigerant that obtained heat from the outdoor air in the outdoor heat exchanger 16 is drawn back into the compressor 14 through the four-way valve 15 and the accumulator 18. The indoor air that obtained heat through the heat exchange in the indoor heat exchanger 22 warms the room.

Axial Fan

Figure 2:
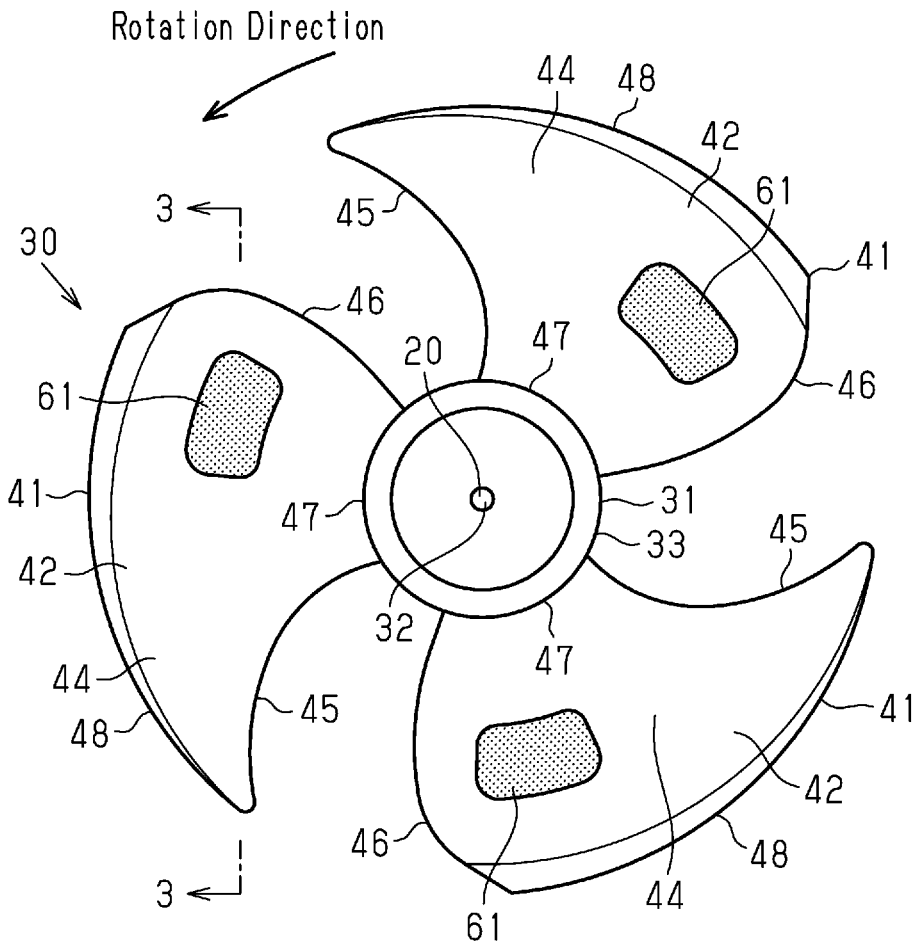
FIG. 2 is a front view of an axial fan in accordance with a first embodiment as viewed from the side of a positive pressure surface.

As shown in FIG. 2, the axial fan 30 includes a hub 31 and five or less blades 41.

The hub 31 is cylindrical. The hub 31 is formed from, for example, resin. The hub 31 includes an insertion hole 32 and an outer circumferential surface 33. The insertion hole 32 is located at the center of the hub 31 in a radial direction. The insertion hole 32 receives a rotary shaft 20 of the fan motor 19. Rotation of the rotary shaft 20 rotates the axial fan 30. The rotary shaft 20 is rotated in a single direction. In the description hereafter, a rotation direction refers to a direction in which the rotary shaft 20 rotates.

The number of blades 41 is three. The number of blades 41 may be five, four, or two. The blades 41 are arranged on the outer circumferential surface 33 of the hub 31. The blades 41 each extend from the outer circumferential surface 33 in the radial direction of the hub 31. The radial direction of the hub 31 is a direction orthogonal to the rotary shaft 20. The blades 41 are arranged at intervals in the rotation direction. The three blades 41 are identical in shape. In the description hereafter, a radial direction refers to the radial direction of the hub 31.

Figure 3:
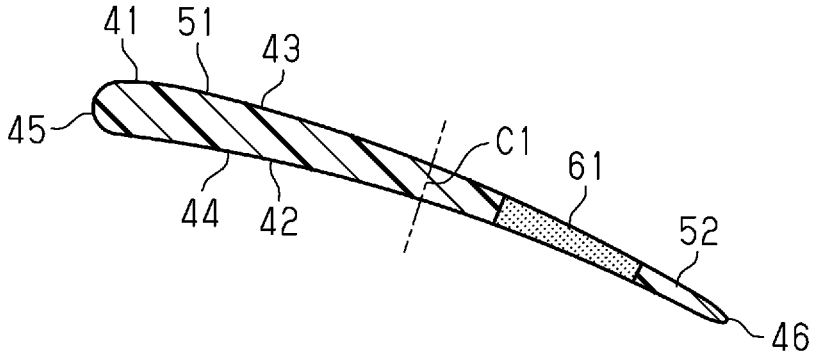
FIG. 3 is a cross-sectional view of a blade in accordance with the first embodiment taken along line 3-3 shown in FIG. 2.

As shown in FIG. 3, the blade 41 includes a positive pressure surface 42 and a negative pressure surface 43. The positive pressure surface 42 is a blade surface located at a positive pressure side of an airflow generated by rotation of the axial fan 30. The negative pressure surface 43 is a blade surface located at a negative pressure side of an airflow generated by rotation of the axial fan 30. The positive pressure surface 42 is a surface from which air flows out when the axial fan 30 is rotated. The negative pressure surface 43 is a surface into which air flows when the axial fan 30 is rotated.

As shown in FIG. 2, the blades 41 each include a main body 44 and a porous part 61. The main body 44 is formed from, for example, resin. The hub 31 and the main body 44 are integrated with each other. The hub 31 and the main body 44 are integrally formed by, for example, injection molding.

The main body 44 includes a leading edge 45, a trailing edge 46, an inner peripheral edge 47, and an outer peripheral edge 48. The leading edge 45 is an edge located forward in the rotation direction. The trailing edge 46 is an edge located rearward in the rotation direction. The leading edge 45 is curved. The leading edge 45 is curved in an arcuate manner so as to be recessed toward the trailing edge 46. The trailing edge 46 is curved. The trailing edge 46 is curved in an arcuate manner so as to extend away from the leading edge 45. The inner peripheral edge 47 is joined to the hub 31. The inner peripheral edge 47 extends between the leading edge 45 and the trailing edge 46. The outer peripheral edge 48 extends between the leading edge 45 and the trailing edge 46. A radial distance from the rotary shaft 20 to the inner peripheral edge 47 is less than a radial distance from the rotary shaft 20 to the outer peripheral edge 48. The outer peripheral edge 48 is curved. The outer peripheral edge 48 is curved in an arcuate manner so as to project in the radial direction.

Figure 4:
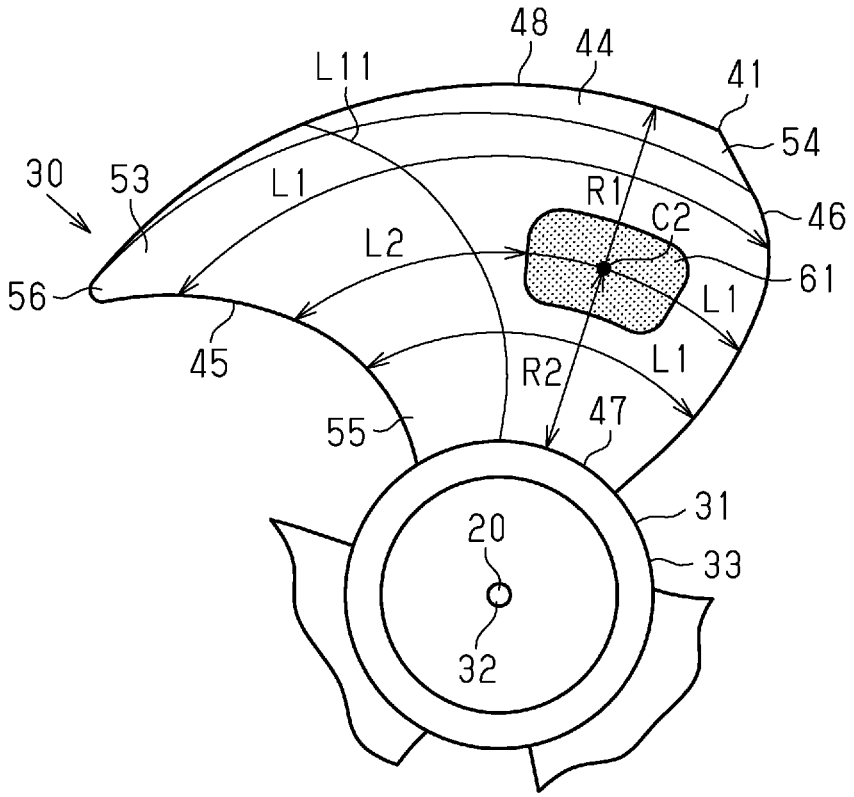
FIG. 4 is an enlarged view of the blade in accordance with the first embodiment.

As shown in FIG. 4, a dimension from the leading edge 45 to the trailing edge 46 will be referred to as a blade chord length L1. More specifically, the blade chord length L1 corresponds to a dimension of an imaginary line that connects multiple points located at the same radial distance from the rotary shaft 20 between the leading edge 45 and the trailing edge 46. In other words, the blade chord length L1 corresponds to a length of an arc extending between the leading edge 45 and the trailing edge 46 of the blade 41 when an imaginary circle is drawn about the rotary shaft 20. FIG. 4 shows three blade chord lengths L1 as an example. The blade chord length L1 may vary depending on its position on the blade 41 in the radial direction.

As shown in FIG. 3, a portion between a center position C1 of the blade chord length L1 and the leading edge 45 is defined as a leading edge portion 51, and a portion between the center position C1 of the blade chord length L1 and the trailing edge 46 is defined as a trailing edge portion 52. The leading edge portion 51 is heavier than the trailing edge portion 52. For example, as shown in FIG. 3, the main body 44 is gradually increased in thickness from the trailing edge 46 toward the leading edge 45 such that the leading edge portion 51 is heavier than the trailing edge portion 52. Alternatively, part of the leading edge portion 51 may be greater in thickness than the trailing edge portion 52 such that the leading edge portion 51 is heavier than the trailing edge portion 52.

The porous part 61 is formed from a synthetic resin or ceramic. The porous part 61 has a lower strength than the main body 44. The porous part 61 is arranged in a region surrounded by the leading edge 45, the trailing edge 46, the inner peripheral edge 47, and the outer peripheral edge 48. The porous part 61 is entirely surrounded by the main body 44 that has a higher strength than the porous part 61. The porous part 61 includes pores extending between the positive pressure surface 42 and the negative pressure surface 43. The porous part 61 has an average pore diameter of, for example, 700 μm or less. The porous part 61 has a thickness of, for example, 5 mm or less. The porous part 61 is integrated with the main body 44. The porous part 61 and the main body 44 are integrated with each other by, for example, insert molding, adhesion, or fitting.

The porous part 61 is quadrangular. More specifically, the porous part 61 has the form of a rounded quadrangle in which the four corners are curved.

As shown in FIG. 4, a distance from the leading edge 45 to the porous part 61 will be referred to as an arrangement distance L2. More specifically, the arrangement distance L2 corresponds to a dimension of an imaginary line that connects multiple points located at the same radial distance from the rotary shaft 20 between the leading edge 45 and the porous part 61. At the locations where the radial distance from the rotary shaft 20 is the same, "arrangement distance L2/blade chord length L1≥40%" is satisfied. In other words, the porous part 61 is arranged at a position located rearward from the leading edge 45 by 40% or more of the blade chord length L1. FIG. 4 shows a borderline L11 that lies along multiple points located rearward from the leading edge 45 by 40% of the blade chord length L1. A first region 53 is defined between the leading edge 45 and the borderline L11. A second region 54 is defined between the first region 53 and the trailing edge 46. The second region 54 includes the borderline L11. The porous part 61 is arranged only in the second region 54. The porous part 61 is not arranged in the first region 53. In other words, the porous part 61 is shifted toward the trailing edge 46. The portion of the porous part 61 included in the trailing edge portion 52 is larger than the portion of the porous part 61 included in the leading edge portion 51.

In the present embodiment, the arrangement distance L2 and the blade chord length L1 both vary in accordance with the position from the rotary shaft 20 in the radial direction. In this case, the porous part 61 of the present embodiment is arranged such that "arrangement distance L2/blade chord length L1≥40%" is satisfied regardless of the position from the rotary shaft 20 in the radial direction.

The porous part 61 is arranged to reduce noise generated by the rotation of the axial fan 30. The noise reduction effect of the porous part 61 changes depending on the position where the porous part 61 is arranged.

Figure 5:
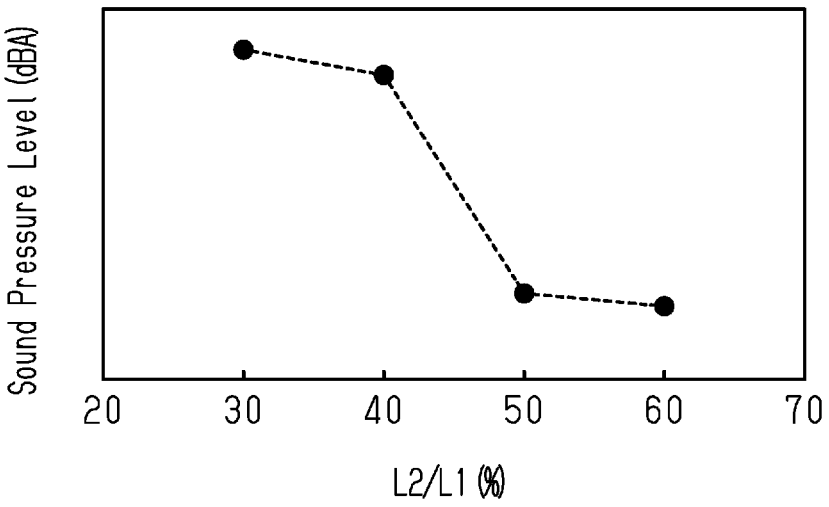
FIG. 5 is a diagram showing the relationship between a sound pressure level of noise generated by rotation of the axial fan and the position of a porous part.

FIG. 5 indicates that a sound pressure level (dBA) of the noise generated by the axial fan 30 decreases as "arrangement distance L2/blade chord length L1 (%)" is increased. In particular, when "arrangement distance L2/blade chord length L1" is set to 40% or more, the sound pressure level decreases significantly.

As shown in FIG. 4, a radial distance from the inner peripheral edge 47 to the outer peripheral edge 48 will be referred to as a first blade length R1. A radial distance from the inner peripheral edge 47 to a center position C2 of the porous part 61 will be referred to as a second blade length R2. The center position C2 of the porous part 61 is located at the center of the porous part 61 in the radial direction. The second blade length R2 and the first blade length R1 satisfy "second blade length R2/first blade length R1≥50%". The porous part 61 is shifted from the center position, between the inner peripheral edge 47 and the outer peripheral edge 48, toward the outer peripheral edge 48. The blade 41 may be divided into an inner peripheral region 55 and an outer peripheral region 56 by a boundary that extends along the center position of the blade 41 in the radial direction. The inner peripheral region 55 is located closer to the hub 31 than the outer peripheral region 56 is to the hub 31. In this case, portion of the porous part 61 included in the outer peripheral region 56 is larger than portion of the porous part 61 included in the inner peripheral region 55.

The main body 44 has a larger area than the porous part 61 on the positive pressure surface 42. In the present embodiment, the porous part 61 has an area that is 30% or less of the entire area of the positive pressure surface 42.

Operation of the First Embodiment

As the blade chord length L1 is increased, noise is more likely to be generated at the side of the blade 41 near the trailing edge 46. When the number of blades 41 is five or less, the blade chord length L1 may be increased in order to secure a desired workload. Accordingly, when the number of blades 41 is five or less, noise is likely to be generated at the side of each blade 41 near the trailing edge 46. A pressure fluctuation may cause generation of noise. When a pressure fluctuation occurs, the air moves between the side of the positive pressure surface 42 and the side of the negative pressure surface 43 through the porous part 61 so as to mitigate the pressure fluctuation. In particular, the porous part 61 located rearward from the leading edge 45 by 40% or more of the blade chord length L1 mitigates pressure fluctuations in the vicinity of the trailing edge 46 of the blade 41.

Figure 6:
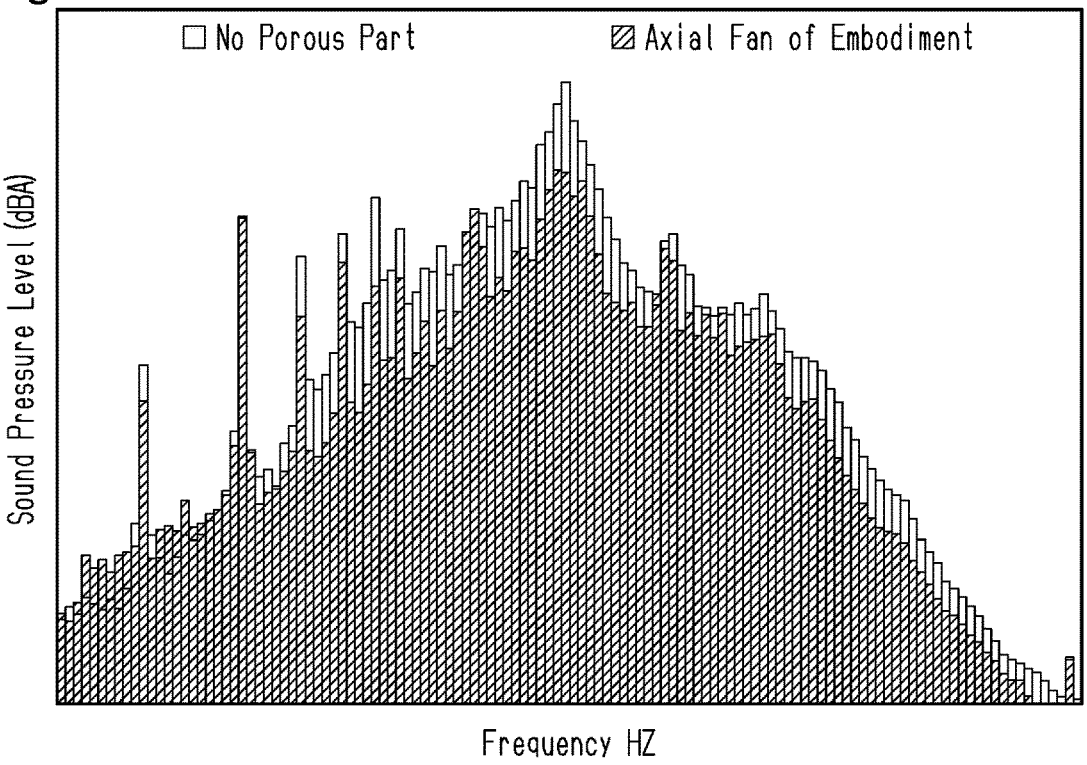
FIG. 6 is a diagram showing the sound pressure level of each frequency in an axial fan without the porous part and the axial fan in accordance with the first embodiment.

FIG. 6 shows the sound generated by the rotation of the axial fan 30, the sound being broken down by frequency, and the sound pressure level corresponding to each frequency. FIG. 6 indicates that the axial fan 30 of the present embodiment reduces the sound pressure level compared to an axial fan without the porous part 61. In particular, the reduction in the sound pressure level is outstanding at a frequency at which the sound pressure level is relatively high.

Advantages of First Embodiment

The first embodiment has the following advantages.

(1-1) The porous part 61 is located rearward from the leading edge 45 by 40% or more of the blade chord length L1. When the porous part 61 is arranged at a location where noise is likely to be generated, the porous part 61 may be reduced in size as compared to when the porous part 61 is arranged over the entire blade 41. This limits decreases in the strength of the blade 41.

Even when the porous part 61 is reduced in size, the porous part 61 arranged at a location where noise is likely to be generated reduces the noise generated by the rotation of the axial fan 30. Thus, the noise reduction effect of the porous part 61 can be obtained while limiting decreases in the strength of the blade 41.

(1-2) The porous part 61 is shifted toward the outer peripheral edge 48. The relative velocity of an airflow increases toward the outer peripheral edge 48. Further, an airflow having a higher relative velocity is more likely to generate noise. Thus, the porous part 61 shifted toward the outer peripheral edge 48 reduces noise.

(1-3) The area of the main body 44 is greater than the area of the porous part 61 on the positive pressure surface 42. The majority of the blade 41 is the main body 44 and the porous part 61 is included locally. The porous part 61 having a lower strength than the main body 44 is locally included, thereby limiting decreases in the strength of the blade 41. In particular, the area of the porous part 61 is set to 30% or less of the entire area of the positive pressure surface 42. This appropriately limits decreases in the strength of the blade 41.

(1-4) The leading edge portion 51 is heavier than the trailing edge portion 52 such that stress of the rotation of the axial fan 30 tends to concentrate in the leading edge portion 51. If the porous part 61 is arranged in the leading edge portion 51, where stress tends to concentrate, the strength of the leading edge portion 51 may become insufficient. When the porous part 61 is arranged within the second region 54, the porous part 61 is less likely to be located in the leading edge portion 51. Thus, the strength of the leading edge portion 51 will not be insufficient.

(1-5) The axial fan 30 is used in the air conditioner 10. The air conditioner 10 may have a large air capacity for better energy saving performances. In order to obtain a larger air capacity, the number of rotations of the axial fan 30 or the size of the axial fan 30 may be increased. In this case, the axial fan 30 needs to have a higher strength. Nonetheless, if the porous part 61 is reduced in size so as to increase the strength of the axial fan 30, noise may increase. In this respect, the porous part 61 of the present embodiment arranged at a location where noise is likely to be generated reduces noise with a relatively small amount of porous part 61. This achieves compatibility between the strength of the axial fan 30 and the noise reduction effect.

Second Embodiment

A second embodiment of the axial fan will now be described. In the second embodiment, the differences from the first embodiment will be described. The same reference names are given to those elements that are the same as the corresponding elements of the first embodiment, and such elements will not be described in detail.

Figure 7:
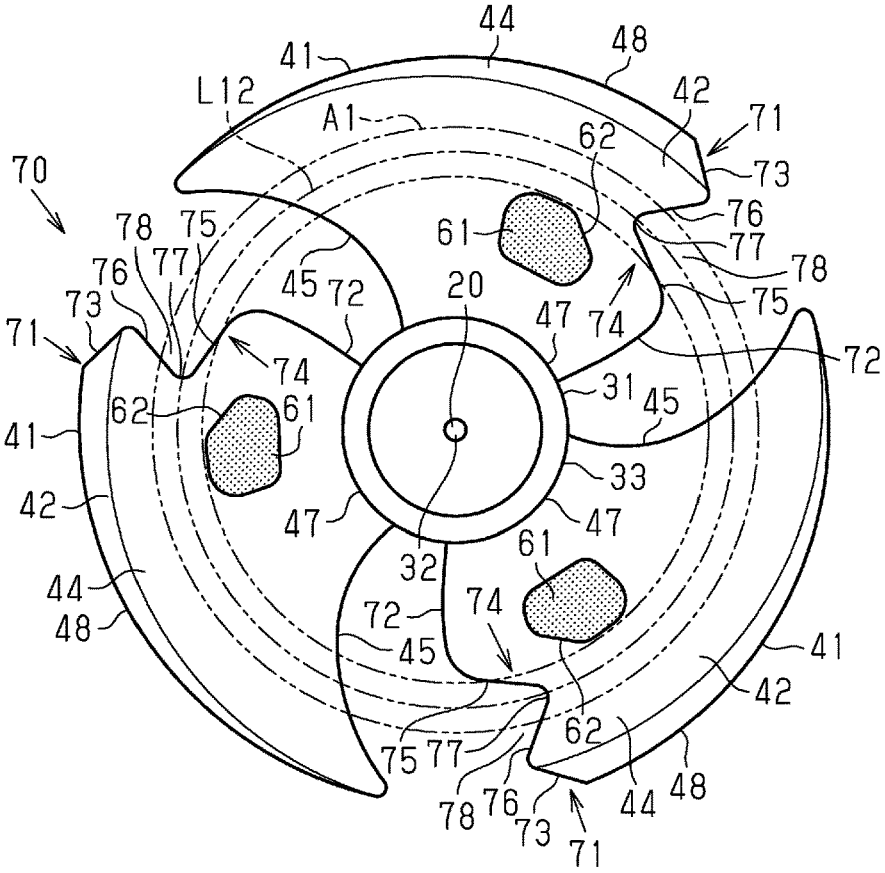
FIG. 7 is a front view of an axial fan in accordance with a second embodiment as viewed from the side of a positive pressure surface.

As shown in FIG. 7, a trailing edge 71 of an axial fan 70 includes an inner peripheral connecting part 72, an outer peripheral connecting part 73, and a notch defining part 74.

The inner peripheral connecting part 72 is connected to the inner peripheral edge 47. The inner peripheral connecting part 72 extends between the inner peripheral edge 47 and the notch defining part 74. The inner peripheral connecting part 72 is inclined rearward from the inner peripheral edge 47 toward the notch defining part 74.

The outer peripheral connecting part 73 is connected to the outer peripheral edge 48. The outer peripheral connecting part 73 extends between the outer peripheral edge 48 and the notch defining part 74. The outer peripheral connecting part 73 is inclined rearward from the outer peripheral edge 48 toward the notch defining part 74.

The notch defining part 74 is located between the inner peripheral connecting part 72 and the outer peripheral connecting part 73. The notch defining part 74 connects the inner peripheral connecting part 72 and the outer peripheral connecting part 73. The notch defining part 74 includes a first section 75, a second section 76, and a third section 77.

The first section 75 is connected to the inner peripheral connecting part 72. The first section 75 extends from the inner peripheral connecting part 72 toward the leading edge 45. The first section 75 is inclined so as to approach the outer peripheral edge 48 as the first section 75 becomes farther away from the inner peripheral connecting part 72.

The second section 76 is connected to the outer peripheral connecting part 73. The second section 76 extends from the outer peripheral connecting part 73 toward the leading edge 45. The second section 76 is inclined so as to approach the inner peripheral edge 47 as the second section 76 becomes farther away from the outer peripheral connecting part 73. The distance between the first section 75 and the second section 76 decreases as the first section 75 and the second section 76 approach the leading edge 45.

The third section 77 connects the first section 75 and the second section 76. The third section 77 is curved so as to be recessed toward the leading edge 45. A notch 78 is formed in a region surrounded by the first section 75, the second section 76, and the third section 77. The notch defining part 74 defines the notch 78. The notch 78 is arranged to increase the air flow rate and reduce noise. The notch 78 extends between the positive pressure surface 42 and the negative pressure surface 43. The notch 78 is recessed toward the leading edge 45.

Figure 8:
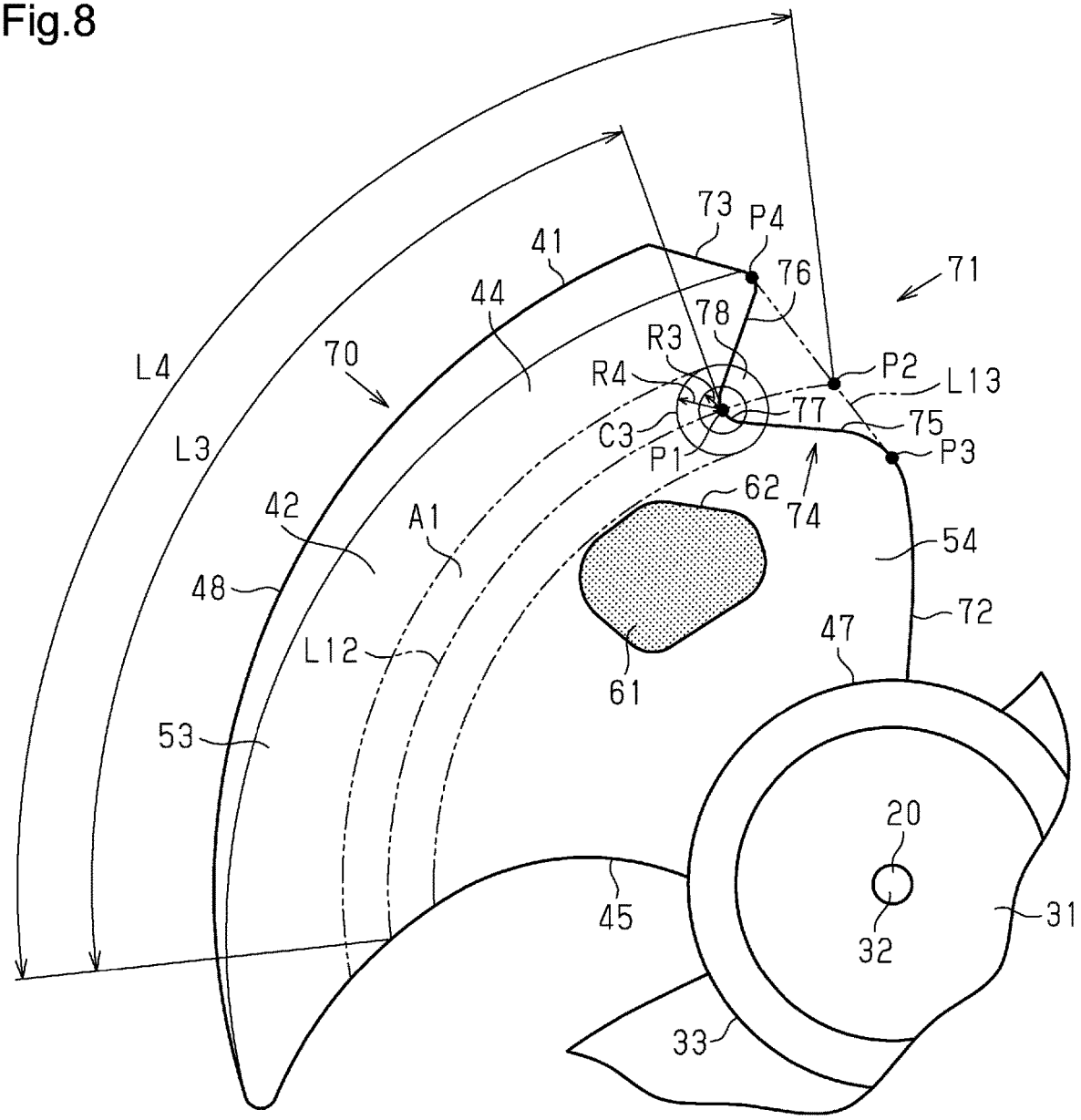
FIG. 8 is an enlarged view of a blade in accordance with the second embodiment.

As shown in FIG. 8, an imaginary line extending in the rotation direction through a center position P1 of the third section 77 will be referred to as a trajectory L12. A length of the trajectory L12 from the leading edge 45 to the center position P1 of the third section 77 will be referred to as a first distance L3. The center position P1 of the third section 77 corresponds to a point of the notch defining part 74 located closest to the leading edge 45.

A point at which the trajectory L12 intersects an imaginary line segment L13 connecting the first section 75 and the second section 76 will be referred to as an intersection P2. A length of the trajectory L12 from the leading edge 45 to the intersection P2 will be referred to as a second distance L4. The line segment L13 connects a point P3 of the first section 75 located closest to the inner peripheral edge 47 and a point P4 of the second section 76 located closest to the outer peripheral edge 48. The first distance L3 is 95% or less of the second distance. In other words, the notch 78 is recessed such that the center position P1 is located forward from the intersection P2 by 5% or more of the second distance L4.

The blade 41 includes a non-arrangement range A1. The non-arrangement range A1 includes the trajectory L12 and is included in a range obtained by extending the notch 78 in the rotation direction. The non-arrangement range A1 of the present embodiment is a range obtained by extending, in the rotation direction, a circular range C3 centered on the center position P1 of the third section 77 and having a radius R4 that is 5 mm greater than a radius R3 of the third section 77. The non-arrangement range A1 extends from the trajectory L12 as a centerline toward both the inner peripheral edge 47 and the outer peripheral edge 48.

The porous part 61 is located at a position outside the non-arrangement range A1. In the present embodiment, the porous part 61 is located between the non-arrangement range A1 and the inner peripheral edge 47. The porous part 61 may be located between the non-arrangement range A1 and the outer peripheral edge 48. The porous part 61 is arranged so as to not overlap the trajectory L12.

The porous part 61 is separated from the center position P1 by a predetermined distance or more. Stress tends to concentrate in the notch defining part 74. In particular, stress tends to concentrate at the center position P1. Accordingly, the porous part 61 is separated from the center position P1 by a predetermined distance or more. In the present embodiment, the porous part 61 includes a cutout 62. The cutout 62 is formed at one of the four corners of the porous part 61 that is closest to the center position P1. The cutout 62 is a part where the corner is cut out. The cutout 62 is arranged such that the porous part 61 is located outside a predetermined distance from the center position P1. This allows the porous part 61 to be adjacent to the trailing edge 71 without becoming excessively close to the center position P1. The cutout 62 is arranged to be parallel to the first section 75. The predetermined distance may be, for example, greater than the radius R4. However, there is no limit to such a configuration, and the predetermined distance may be changed in any manner.

Advantages of the Second Embodiment

The second embodiment has the following advantages in addition to the advantages of the first embodiment.

(2-1) Stress tends to concentrate in the third section 77. Thus, if the distance between the third section 77 and the porous part 61 is excessively short, the strength of the blade 41 may decrease. When the porous part 61 is arranged at a position outside the non-arrangement range A1, decreases in the strength of the blade 41 are limited as compared to when the porous part 61 is arranged inside the non-arrangement range A1.

Third Embodiment

A third embodiment of the axial fan will now be described. In the third embodiment, the differences from the first embodiment will be described. The same reference names are given to those elements that are the same as the corresponding elements of the first embodiment, and such elements will not be described in detail.

Figure 9:
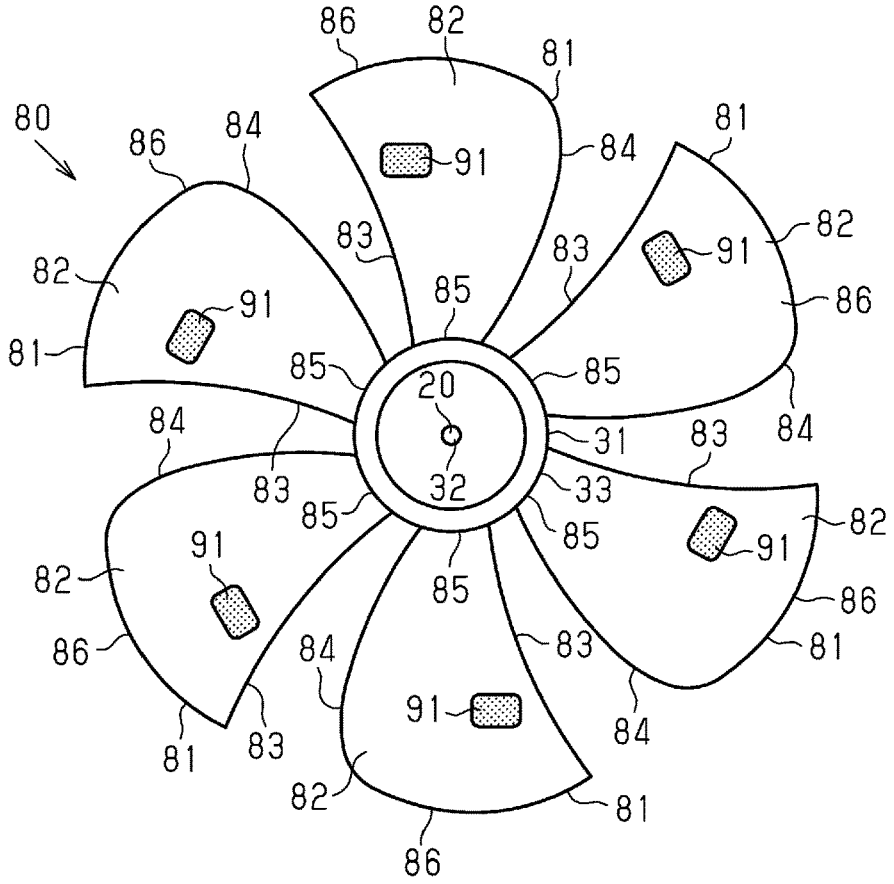
FIG. 9 is a front view of an axial fan in accordance with a third embodiment as viewed from the side of a positive pressure surface.

As shown in FIG. 9, an axial fan 80 includes six or more blades 81. The number of blades 81 shown in FIG. 9 is six. The number of blades 81 may be seven or more. The six blades 81 are identical in shape.

Each of the blades 81 includes a main body 82 and a porous part 91. The main body 82 includes a leading edge 83, a trailing edge 84, an inner peripheral edge 85, and an outer peripheral edge 86.

Figure 10:
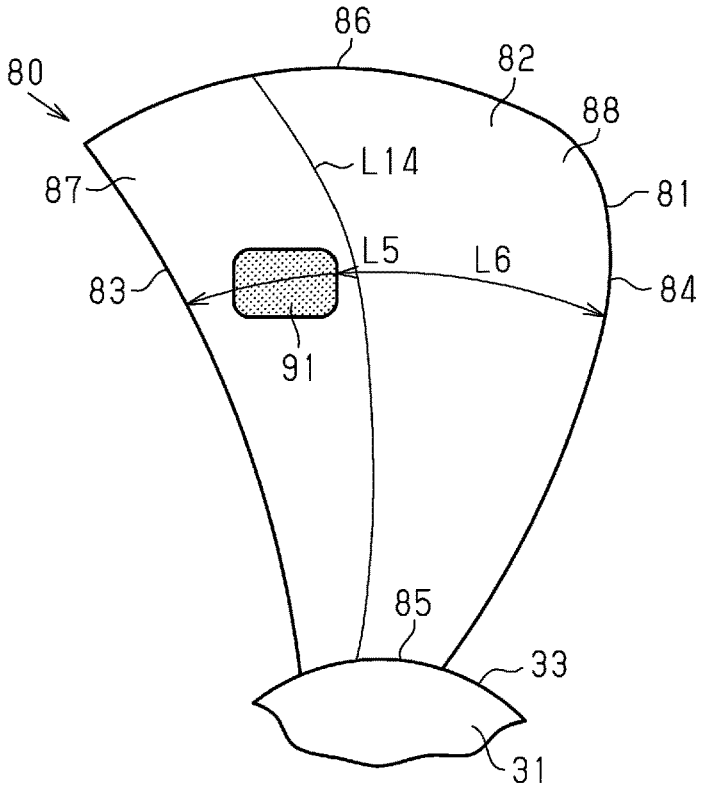
FIG. 10 is an enlarged view of a blade in accordance with the third embodiment.

As shown in FIG. 10, a dimension from the leading edge 83 to the trailing edge 84 will be referred to as a blade chord length L5. A distance from the trailing edge 84 to the porous part 91 will be referred to as an arrangement distance L6. At locations where the radial distance from the rotary shaft 20 is the same, "arrangement distance L6/blade chord length L5≥60%" is satisfied. In other words, the porous part 91 is arranged at a position located forward from the trailing edge 84 by 60% or more of the blade chord length L5. FIG. 10 shows an imaginary borderline L14 that connects multiple points separated from the trailing edge 84 by 60% of the blade chord length L5. A first region 87 is defined between the leading edge 83 and the borderline L14. A second region 88 is defined between the first region 87 and the trailing edge 84. The porous part 91 is arranged only in the first region 87.

In other words, the porous part 91 is shifted from a center position of the blade chord length L5 toward the leading edge 83.

In the present embodiment, a center position between the inner peripheral edge 85 and the outer peripheral edge 86 may vary in accordance with its position in the rotation direction. The porous part 91 of the present embodiment is shifted from the center position, between the inner peripheral edge 85 and the outer peripheral edge 86, toward the outer peripheral edge 48 regardless of the position in the rotation direction.

Operation of the Third Embodiment

As the blade chord length L5 is decreased, noise is more likely to be generated at the side of the blade 81 near the leading edge 83. When the number of blades 81 is six or more, the blade chord length L5 may be decreased in order to ensure formability of the axial fan 80 and secure flow paths between the blades 81. Accordingly, when the number of blades 81 is six or more, noise is likely to be generated at the side of each blade 81 near the leading edge 83. The porous part 91 is located forward from the trailing edge 84 by 60% or more of the blade chord length L5. This arranges the porous part 91 at a location where noise is likely to be generated. Consequently, noise is reduced at the side of the blade 81 near the leading edge 83.

Advantage of the Third Embodiment

The third embodiment has the following advantages. In addition to the advantages (1-2), (1-3), and (1-5) of the first embodiment, the second embodiment has the following advantage.

(3-1) The porous part 91 is arranged at a location where noise is likely to be generated. Thus, the porous part 91 may be reduced in size as compared to when the porous part 91 is arranged over the entire blade 81. This limits decreases in the strength of the blade 81.

Even when the porous part 91 is reduced in size, the porous part 91 arranged at a location where noise is likely to be generated reduces the noise generated by the rotation of the axial fan 80. Thus, the noise reduction effect of the porous part 91 can be obtained while limiting decreases in the strength of the blade 81.

MODIFIED EXAMPLES

In addition to the above embodiments, the axial fan of the present disclosure is applicable to, for example, the following modifications and combinations of at least two of the modifications that do not contradict each other.

In the second embodiment, the porous part 61 may be located forward from a position separated from the leading edge 45 by 40% of the blade chord length L1.

In the second embodiment, the number of blades 41 may be six or more.

In the third embodiment, the trailing edge 84 may include a notch defining part.

It should be understood that the above-described disclosure may be embodied in many other specific forms within the scope and equivalence of the axial fan described in the appended claims.

CLAUSES

Technical concepts obtained from the above embodiments and the modified examples will now be described.

(1) An axial fan including a hub and a blade. The hub is for attachment to a rotary shaft. The blade is arranged on the hub. The blade includes a leading edge, a trailing edge, an inner peripheral edge, an outer peripheral edge, and a porous part. The leading edge is located forward in a rotation direction of the rotary shaft. The trailing edge is located rearward in the rotation direction of the rotary shaft. The inner peripheral edge is joined to the hub. The outer peripheral edge extends between the leading edge and the trailing edge in the rotation direction of the rotary shaft. The leading edge includes a notch defining part that forms a notch recessed toward the leading edge. The porous part is arranged so as to not overlap a trajectory that extends in the rotation direction through a point of the notch defining part located closest to the leading edge.

(2) An axial fan including a hub and six or more blades. The hub is for attachment to a rotary shaft. The blades are arranged on the hub. The blades each include a leading edge, a trailing edge, and a porous part. The leading edge is located forward in a rotation direction of the rotary shaft. The trailing edge is located rearward in the rotation direction of the rotary shaft. When a dimension from the leading edge to the trailing edge is referred to as a blade chord length, the porous part is shifted from a center position of the blade chord length toward the leading edge.

What is claimed is:

1. An axial fan, comprising:

a hub attachable to a rotary shaft; and five or less blades arranged on the hub, each blade including a leading edge located forward in a rotation direction of the rotary shaft, a trailing edge located rearward in the rotation direction of the rotary shaft, an inner peripheral edge joined to the hub, an outer peripheral edge extending between the leading edge and the trailing edge in the rotation direction of the rotary shaft, and a porous part, the trailing edge including an inner peripheral connecting part connected to the inner peripheral edge, an outer peripheral connecting part connected to the outer peripheral edge, a first section extending from the inner peripheral connecting part toward the leading edge, a second section extending from the outer peripheral connecting part toward the leading edge, and a third section curved and connecting the first section and the second section;

a length of a trajectory in the rotation direction from the leading edge to a first center position of the third section is a first distance, a length of the trajectory in the rotation direction from the leading edge to an intersection at which the trajectory intersects an imaginary line segment connecting the first section and the second section is a second distance, and the first distance is 95% or less of the second distance, a dimension from the leading edge to the trailing edge being a blade chord length, and the porous part being arranged at a position located rearward from the leading edge by 40% or more of the blade chord length, and a non-arrangement range being obtained by extending, in the rotation direction, a circular range centered on the first center position of the third section and having a radius that is 5 mm greater than a radius of the third section, and the porous part being located only at a position outside the non-arrangement range.

2. The axial fan according to claim 1, wherein the porous part is shifted from a second center position, between the inner peripheral edge and the outer peripheral edge, toward the outer peripheral edge.

3. The axial fan according to claim 2, wherein the porous part has an area that is 30% or less of an entire area of a positive pressure surface of a corresponding one of the blades.

4. The axial fan according to claim 1, wherein the porous part has an area that is 30% or less of an entire area of a positive pressure surface of a corresponding one of the blades.

5. An axial fan, comprising:

a hub attachable to a rotary shaft; and a blade arranged on the hub, the blade including a leading edge located forward in a rotation direction of the rotary shaft, a trailing edge located rearward in the rotation direction of the rotary shaft, an inner peripheral edge joined to the hub, an outer peripheral edge extending between the leading edge and the trailing edge in the rotation direction of the rotary shaft, and a porous part, the trailing edge including an inner peripheral connecting part connected to the inner peripheral edge, an outer peripheral connecting part connected to the outer peripheral edge, a first section extending from the inner peripheral connecting part toward the leading edge, a second section extending from the outer peripheral connecting part toward the leading edge, and a third section curved and connecting the first section and the second section, a length of a trajectory in the rotation direction from the leading edge to a first center position of the third section being a first distance, a length of the trajectory in the rotation direction from the leading edge to an intersection at which the trajectory intersects an imaginary line segment connecting the first section and the second section is a second distance, and the first distance is 95% or less of the second distance, and a non-arrangement range being obtained by extending, in the rotation direction, a circular range centered on the first center position of the third section and having a radius that is 5 mm greater than a radius of the third section, and the porous part being located only at a position outside the non-arrangement range.

6. An axial fan, comprising:

a hub attachable to a rotary shaft; and six or more blades arranged on the hub, each blade including a leading edge located forward in a rotation direction of the rotary shaft, a trailing edge located rearward in the rotation direction of the rotary shaft, an inner peripheral edge joined to the hub, an outer peripheral edge extending between the leading edge and the trailing edge in the rotation direction of the rotary shaft, and a porous part, a dimension from the leading edge to the trailing edge being a blade chord length, the porous part being arranged only at a position located forward from the trailing edge by 60% or more of the blade chord length, and the porous part being arranged only in a region between a second center position and the outer peripheral edge, the second center position being located midway between the inner peripheral edge and the outer peripheral edge.

* * * * *